US006061961A

United States Patent [19]

Rupe

[11] Patent Number: 6,061,961

[45] Date of Patent: May 16, 2000

[54] SWINGING SECURITY DOOR

[76] Inventor: Maurice J. Rupe, 13342 E. Jupiter Way, Chandler, Ariz. 85225

[21] Appl. No.: 09/336,864

[22] Filed: Jun. 18, 1999

[51] Int. Cl.[7] ..... E05D 15/22

[52] U.S. Cl. ..... 49/164; 49/147; 49/168

[58] Field of Search ..... 49/163, 164, 166, 49/168, 153, 154, 155, 156, 158, 61, 63, 67, 125, 127, 128, 130, 147, 148, 323; 52/207, 243.1

[56] References Cited

U.S. PATENT DOCUMENTS

| | | | |
|---|---|---|---|
| 787,640 | 4/1905 | Robinson . | |
| 1,820,346 | 8/1931 | Christensen . | |
| 2,181,215 | 11/1939 | Sweany | 49/155 |
| 3,334,375 | 8/1967 | Hubbard . | |
| 3,491,483 | 1/1970 | Miller . | |
| 3,990,183 | 11/1976 | Meggs et al. . | |
| 4,305,227 | 12/1981 | Georgelin . | |
| 4,438,594 | 3/1984 | Bunzi . | |
| 5,031,271 | 7/1991 | Baus . | |
| 5,105,868 | 4/1992 | Riise | 49/168 X |
| 5,253,452 | 10/1993 | Goldbach . | |
| 5,682,710 | 11/1997 | Davies et al. . | |

FOREIGN PATENT DOCUMENTS

| | | | |
|---|---|---|---|
| 710082 | 5/1965 | Canada | 49/164 |
| 8131 | 4/1904 | United Kingdom | 49/164 |

*Primary Examiner*—Jerry Redman
*Attorney, Agent, or Firm*—Schmeiser, Olsen & Watts; Albert L. Schmeiser

[57] ABSTRACT

A security door for use with a sliding glass door assembly that is installed in a casing, comprises a frame adapted for rotatable connection to the casing about a generally vertical axis, and first and second panels connected to the frame. The frame includes an upper guide track and a lower guide track that extend in a generally horizontal direction. The first panel is fixedly connected to the upper and lower guide tracks, while the second panel is slidably connected to the upper and lower guide tracks for sliding movement with respect to the first panel between a retracted position wherein the first and second panels are in opposing relationship, and an extended position wherein the trailing edge of the second panel is proximal the leading edge of the first panel. The upper guide track has a length that is approximately equal to a distance between the trailing edge of the first panel and the leading edge of the second panel with the second panel in the extended position. The lower guide track has a length that is approximately equal to a distance traveled by the second panel between the retracted and extended positions. In this manner, the lower guide track does not interfere with an entry/exit path of the sliding glass door assembly.

14 Claims, 6 Drawing Sheets

SWINGING SECURITY DOOR

BACKGROUND OF THE INVENTION

1. Field of the Invention

This invention relates to door assemblies, and more particularly to a security door assembly for installation in casings having premounted doors.

2. Description of the Related Art

Sliding glass door assemblies, commonly known as "sliders,' have become quite popular in residential dwellings and the like due to their ease of installation, convenience in use, and the resulting feelings of "openness" that they create.

Such door assemblies typically include a fixed glass door that is mounted in a frame and a sliding glass door that moves along the frame. A casing is formed in the dwelling and the frame is mounted in the casing. The sliding door can be selectively opened for exiting or entering the dwelling and for allowing outside air into the dwelling. Often, a screen door slides along a track in the frame and is intended to prevent animals, insects and foreign matter from entering the dwelling. The screen door that accompanies such door assemblies is typically quite flimsy. The screen door often separates from the track and the screen material itself is easily separated from the screen door, especially when pressed against by children or pets. Moreover, the screen door itself is unable to adequately protect one of the glass doors, let alone both, against flying objects such as baseballs, rocks, debris tossed by high winds, and so on.

SUMMARY OF THE INVENTION

According to the invention, a door assembly for mounting to a casing comprises a frame adapted for connection to the casing, and first and second panels connected to the frame. The frame includes an upper guide track and a lower guide track. The first panel has a top edge, a bottom edge, and leading and trailing edges that extend between the top and bottom edges. The first panel is connected to the upper and lower guide tracks. The second panel has a top edge, a bottom edge, and leading and trailing edges extending between the top and bottom edges. The second panel is slidably connected to the upper and lower guide tracks for sliding movement with respect to the first panel between a retracted position wherein the first and second panels are in opposing relationship, and an extended position wherein the trailing edge of the second panel is proximal the leading edge of the first panel. One of the upper and lower guide tracks has a length that is approximately equal to a distance between the trailing edge of the first panel and the leading edge of the second panel with the second panel in the extended position. The other of the upper and lower guide tracks has a length that is approximately equal to a distance traveled by the second panel between the retracted and extended positions.

In one preferred embodiment, the frame is mounted to the casing for rotation about a generally vertical axis such that the door assembly, including the first and second panels, can rotate between open and closed positions.

According to a further embodiment of the invention, a security door assembly is provided for mounting to a casing that has at least one movable member for selectively blocking and exposing one environment with another, such as environments associated with the inside and outside of a dwelling or other building or structure, the environments associated with adjacent rooms, etc. The security door assembly comprises a frame adapted for connection to the casing, and first and second panels connected to the frame. The frame includes an upper guide track and a lower guide track. The first panel has a top edge, a bottom edge, and leading and trailing edges that extend between the top and bottom edges. The first panel is connected to the upper and lower guide tracks. The second panel has a top edge, a bottom edge, and leading and trailing edges that extend between the top and bottom edges. The second panel is slidably connected to the upper and lower guide tracks for sliding movement with respect to the first panel between a retracted position wherein the first and second panels are in opposing relationship, and an extended position wherein the trailing edge of the second panel is proximal the leading edge of the first panel. The upper guide track has a first end proximal the trailing edge of the second panel in the retracted position and a second end proximal the leading edge of the second panel in the extended position. The lower guide track has a first end proximal the trailing edge of the second panel when in the retracted position and a second end proximal the trailing edge of the second panel when in the extended position.

There has thus been outlined the more important features of the invention so that the detailed description thereof that follows may be better understood, and so that the present contribution to the art may be better appreciated. There are, of course, additional features of the invention that will be described hereinafter which will form the subject matter of the appended claims.

It is noted that the drawings of the invention may not necessarily be to scale. The drawings are merely schematic representations, not intended to portray specific parameters of the invention. The drawings are intended to depict only typical embodiments of the invention, and therefore should not be considered as limiting the scope of the invention. The invention will be described with additional specificity and detail through the accompanying drawings.

DESCRIPTION OF THE PREFERRED EMBODIMENT

Figure 1:
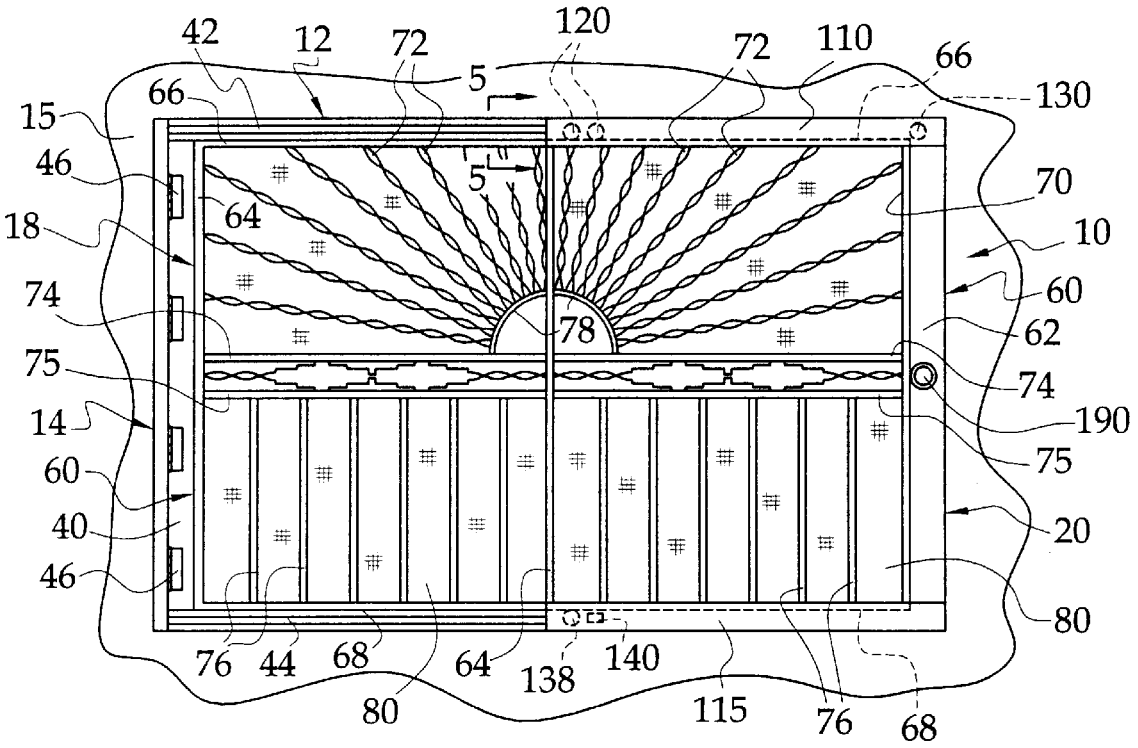
FIG. 1 is a front plan view of a security door according to the invention, with a sliding panel of the security door in an extended position.
Figure 2:
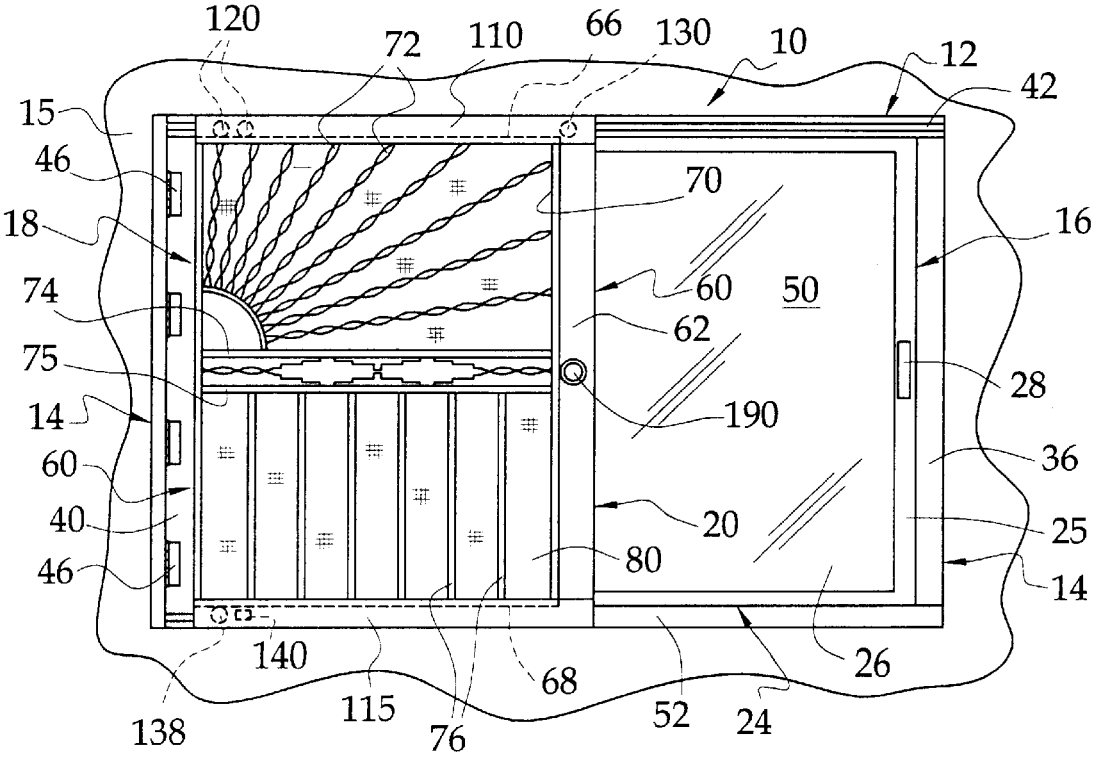
FIG. 2 is a front plan view similar to FIG. 1 with the sliding panel in a retracted position.

Referring now to the drawings, and to FIGS. 1 and 2 in particular, a security door 10 according to the invention comprises a frame 12 mountable to a casing 14 of an entry door assembly 16, a first panel 18 fixedly mounted on the frame 12, and a second panel 20 mounted on the frame 12 for slidable movement relative to the frame and the first panel 18.

The entry door assembly 16 may take several different forms, such as double pivoting or sliding doors installed at entryways or other locations in buildings or other structures, double sliding doors installed in elevators and the like, a single sliding or pivoting door having one or more fixed sidelights or panels, etc.

Figure 3:
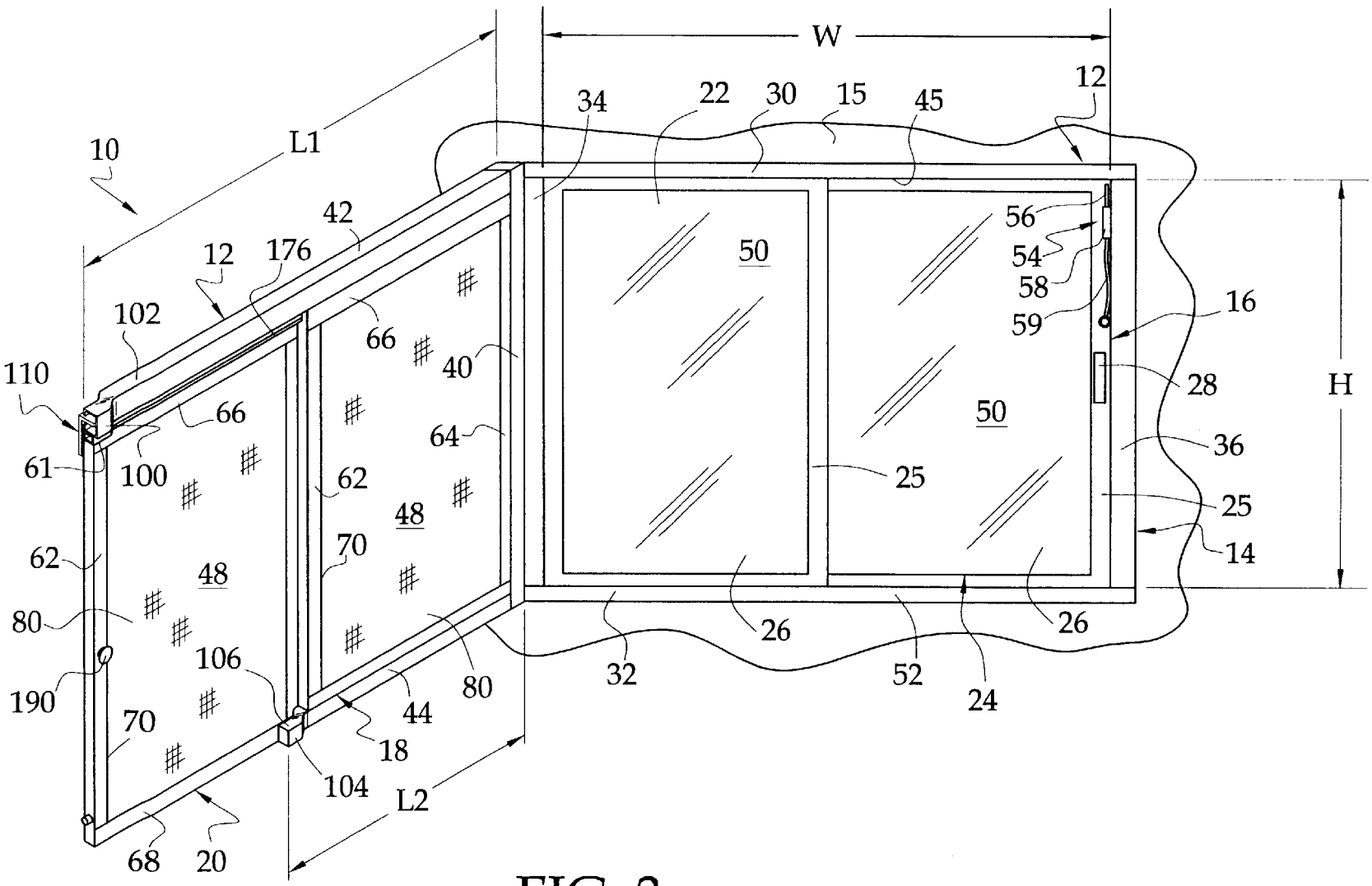
FIG. 3 is a view similar to FIG. 1 and showing the security door pivoted open with the sliding panel in the extended position.
Figure 4:
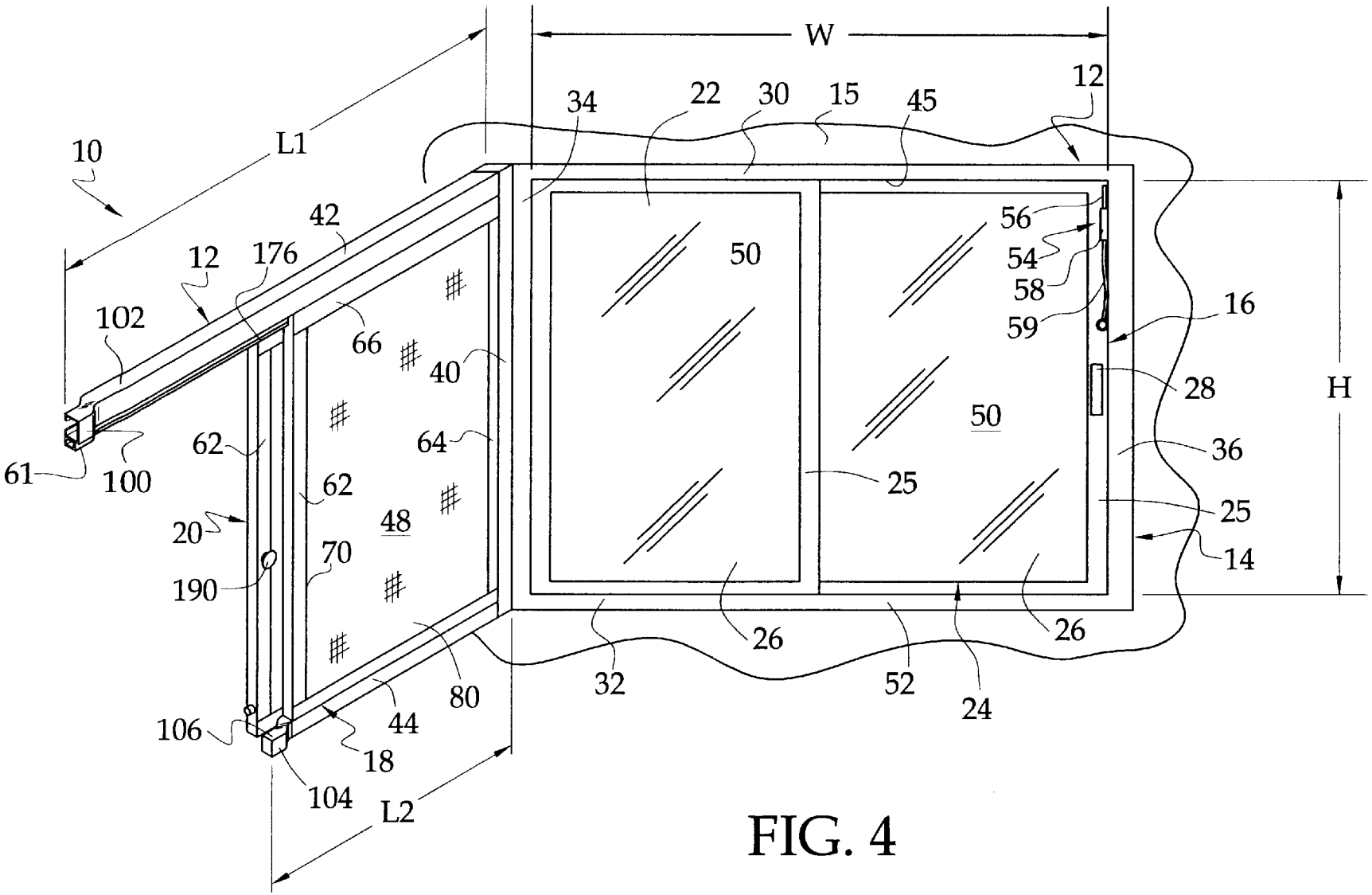
FIG. 4 is a view similar to FIG. 3 with the sliding panel in the retracted position.
Figure 5:
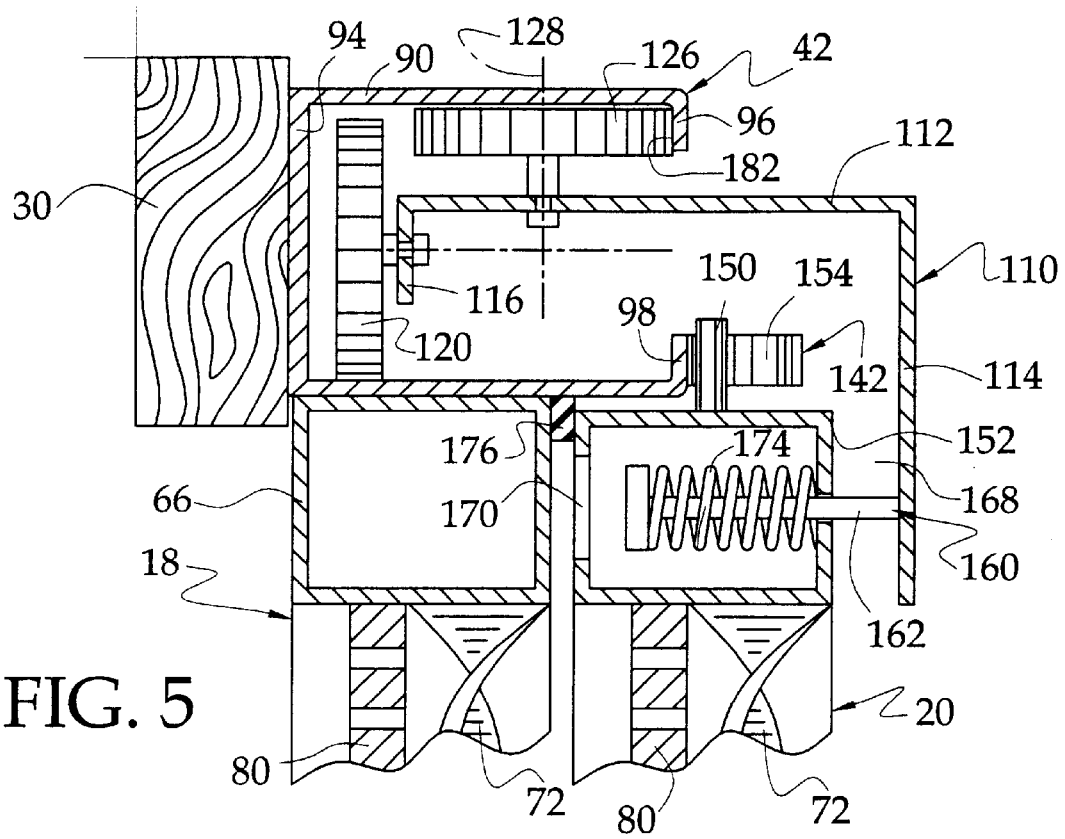
FIG. 5 is a cross section of a portion of the security door taken along line 5—5 of FIG. 1, and illustrating the sliding panel in the extended position.

As illustrated in FIGS. 3 and 4, one typical entry door assembly 16 for homes or other dwellings may include a fixed door 22 mounted on the casing 14 and a sliding door 24 mounted in upper and lower tracks (not shown) that extend along the width of the casing for slidable movement relative to the fixed door 22. Each door may include a frame 25 and a glass pane 26 mounted in the frame. A handle 28 is installed on the sliding door 24 for facilitating movement thereof and for locking the sliding door to the casing 14 in a closed position, in a well-known manner. The security door 10 is intended to cover the entry door assembly 16 from the outside of a home or other structure, whether the sliding door 24 is in an opened or closed position. The security door 10 may also be modified to fit window casings or the like.

The casing 14 is located in an opening of a wall 15 and is conventional in construction. The casing includes a top plate 30, a bottom plate or threshold 32, a first side post 34, and a second side post 36. The first and second side posts extend between the upper and lower plates to form a rectangular casing opening 45 having a width "W" and a height "H" into which the sliding door assembly 16 is mounted.

Referring now to FIGS. 1 to 4, the frame 12 of the security door 10 comprises an upright post 40, an upper guide track 42 connected to upper end of the post 40, and a lower guide track 44 connected to a lower end of the post 40. The upper and lower guide tracks extend generally transverse from the upright post and generally parallel to each other. The upright post 40 is preferably pivotally connected to the casing 14 through a plurality of hinges 46 mounted between the upright post 40 and the first side post 34 of the casing. Although hinges are the preferred arrangement for pivotally connecting the upright post 30 to the casing, other connecting means may be provided. For example, pivot pins (not shown) may extend from opposite ends of the upright post 30 and into sockets (not shown) formed in the upper and lower plates.

The upper guide track 42 preferably has a length $L_1$ that is substantially equal to or slightly less than the width W of the casing opening 45 adjacent the top plate 30, while the lower guide track 44 preferably has a length $L_2$ that is approximately half of the width W. The first panel 18 extends between the upper guide track 42 and the lower guide track 44 and is fixedly connected thereto through fasteners, welding, intermediate brackets, or the like. The second panel 20 is slidably mounted to the upper and lower guide tracks for movement between an extended position (FIG. 1) and a retracted position (FIG. 2). The slidable mounting between the second panel and the upper and lower guide tracks will be described in further detail below.

Since the upper and lower guide tracks 42, 44 are connected to the upright post 40 and the panels 18, 20 are connected between the upper and lower guide tracks, the security door 10 can rotate about the hinges 46 (which define a generally vertical axis) between a closed position (FIGS. 1 and 2) and an open position (FIGS. 3 and 4). As illustrated, the sliding panel 20 may also be moved between the extended position (FIG. 3) to the retracted position (FIG. 4) when the security door is in the open position.

With the above-described arrangement, the inner surfaces 48 of the fixed and sliding panels 18, 20 and the outer surfaces 50 of the glass panes 26, as well as the casing, guide tracks and upright post, can be easily accessed for cleaning, maintenance, repair, and the like, simply by rotating the security door 10 to the open position.

Since the lower guide track 44 extends approximately half the width W of the casing opening 45, the lower guide track 44 does not interfere with an entry/exit portion 52 of the threshold or bottom plate 32. With the entry/exit portion 52 clear of the lower guide track 44, the risk of tripping and/or injury that would otherwise be caused by the lower guide track extending into the entry/exit portion is eliminated.

Referring again to FIGS. 3 and 4, a locking assembly 54 is mounted to the second side post 36 of the casing 14. The locking assembly includes a spring-loaded plunger 56 that extends upwardly from a spring housing 58 and a pull-cord 59 that extends downwardly from the housing. The plunger is adapted to fit in an opening (not shown) of an elongate, tubular member 61 connected to the upper guide track 42 for locking the security door in the closed position.

In use, the security door is rotated to the closed position while the pull-cord 59 is pulled downwardly to thereby lower the plunger 56 to provide clearance for the tubular member 61. Once in the closed position, the pull-cord can be released to thereby permit return of the plunger to its uppermost position under spring force and engage the opening in the tubular member to lock the security door in the closed position. The lock can be released simply by pulling on the cord until the plunger is clear of the tubular member 61, then rotating the security door to an open position.

As shown most clearly in FIGS. 1 and 2, the fixed panel 18 and sliding panel 20 each includes a frame 60 having an upright leading frame section 62 defining a leading edge, an upright trailing frame section 64 defining a trailing edge, an upper cross frame section 66, and a lower cross frame section 68. The upper and lower frame sections 66, 68 extend between, and are connected to the upright frame sections 64, 66 to form a rectangular panel opening 70. A plurality of elongate bars 72 to 78 are located in each opening 70, preferably in an aesthetically pleasing pattern. In one preferred arrangement, and with respect to the panel 20, a bar 78 is formed into a quarter circle and extends between an upper horizontal bar 74 and the trailing frame section 64. The bars 72 are twisted about their respective longitudinal axes and extend radially from the bar 78 to either the leading frame section 62 or the upper frame section 66. Bars 76 extend generally vertically between a lower horizontal bar 75 and the lower frame section 68, preferably at equally spaced intervals. The bars 72 to 78 in the panel 18 are preferably a mirror image of the bars in panel 20. In this manner, the panels 18, 20 form a half sunburst pattern when the sliding panel is in the extended position. A screen 80, which may be constructed of woven material, perforated sheet metal, or the like, is positioned in each opening 70 behind the bars 72 to 78. With this arrangement, the bars 72 to 78 and the screen 80 serve to protect the sliding door assembly 16 against objects hurled by persons or storms, vandalism, and so on, and also to deter intruders when the panel 20 is fully extended and the security door 10 is in the closed position.

With reference now to FIGS. 5 to 8, the upper guide track 42 is substantially U-shaped in cross section with an upper leg 90, a lower leg 92 and a transverse leg 94 extending between the upper and lower legs. A downwardly extending flange 96 is formed at a distal end of the upper leg 90, while an upwardly extending flange 98 is formed at a distal end of the lower leg 92. An S-shaped section 100 is formed at an outer free end 102 of the upper guide track 42. The lower guide track 44 (see FIGS. 4 and 5) is similar in cross section to the upper guide track 42 and also includes a lower S-shaped section 104 formed at an outer end 106 of the lower guide track.

A bearing bracket 110 is connected to the sliding panel 20. The bearing bracket is preferably L-shaped in cross section with a first generally horizontal leg 112 connected to a second generally vertical leg 114. A downwardly extending flange 116 is formed at an outer free end of the leg 112. The bearing bracket 110 preferably extends the length of the sliding panel 20. The lower guide track 44 also includes a bearing bracket 115 (FIG. 1) that is preferably a mirror image of the bearing bracket 110.

A pair of roller bearings 120 are rotatably mounted to the flange 1 16 about rotational axes 124 proximal a trailing edge 122 of the bearing bracket 110. A guide bearing 126 is rotatably mounted to the generally horizontal leg 112 about a rotational axis 128, preferably at a location approximately midway between the rotational axes 124. A single roller bearing 130 (shown in hidden line in FIG. 8) is preferably rotatably mounted to the flange 116 about a rotational axis 132 proximal a leading edge 134 of the bearing bracket 110. A guide bearing 136 (also shown in hidden line) is rotatably mounted to the leg 112. Likewise, a roller bearing 138 and a guide bearing 140 (both shown in hidden line in FIG. 1) are mounted near the trailing edge of the lower bearing bracket 115 in a similar manner. Since the lower guide track 44 extends only approximately half the distance as the upper guide track 42, there is no need for roller and guide bearings at the leading edge of the lower bearing bracket 115.

A generally S-shaped guide bracket 142 is mounted on the upwardly extending flange 98 of the upper guide track 42 at a location that is approximately midway between the ends 144, 146 of the upper guide track. The guide bracket 142 preferably has an inner curved surface 154 (FIG. 6) similar in shape to the curvature of the S-shaped sections 102 and 104. A guide pin 150 is fixedly mounted to an upper wall 152 of the upper cross frame section 66 of the sliding panel 20. The guide pin 150 is adapted to contact the inner curved surface 154 of the guide bracket 142 as the panel 20 is moved to the extended position.

A pair of fasteners 160 are fixedly mounted to the generally vertical leg 114 of the upper bearing bracket 110, preferably in alignment with the rotational axes 124 of the roller bearings 120. Each fastener 160 includes a shaft 162 and a head 164 located at a free end of the shaft. The shaft 162 extends through an opening 166 in an outer side wall 168 of the upper cross frame section 66. When the panel 120 is in the retracted position, the head 164 is coincident with an opening 170 in an inner side wall 172 of the upper cross frame section 66. A compression spring 174 is mounted on the shaft 162 between the head 164 and the outer side wall 168 for normally biasing an upper trailing end of the panel 20 outwardly toward the generally vertical leg 114 of the bearing bracket 110.

A seal 176 is preferably mounted on the fixed panel 18 at extends along the tubular member 61 (FIG. 4). The sliding panel 20 is adapted to engage the seal 176 when in the extended position, as will be described in further detail below, in order to prevent the ingress of moisture, foreign particles, etc., into the space between the sliding door assembly 16 and the security door 10.

Figure 6:
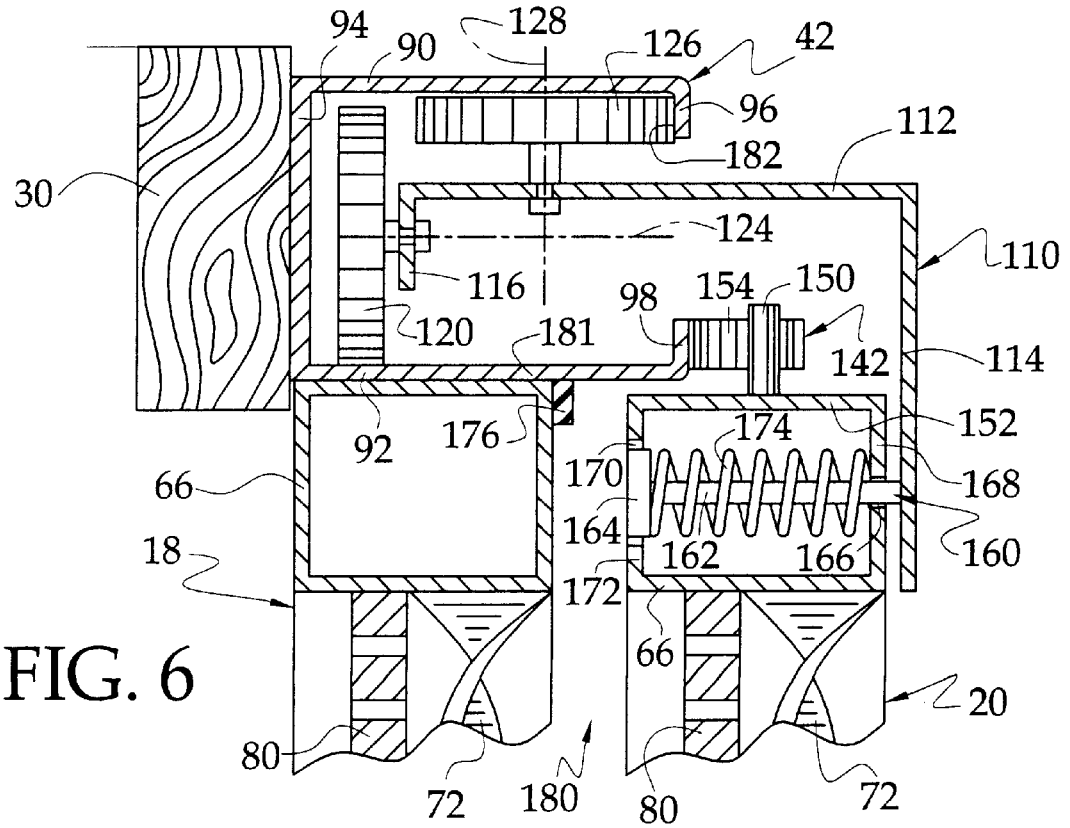
FIG. 6 is a view similar to FIG. 5 and illustrating the sliding panel in at least a partially retracted position.
Figure 7:
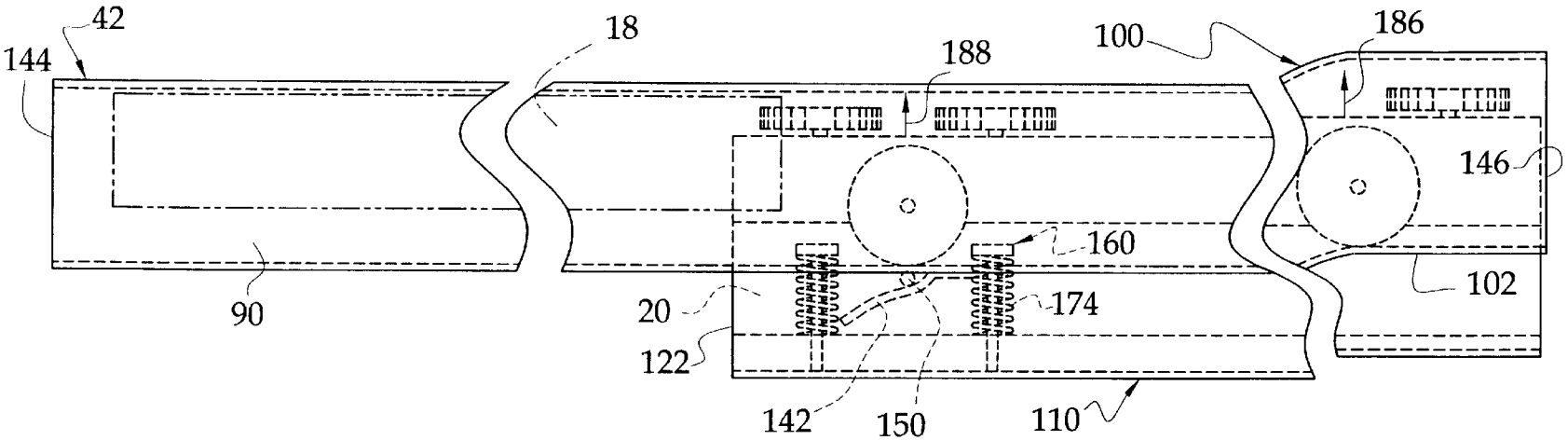
FIG. 7 is a top plan view of the security door with the sliding panel in the extended position.
Figure 8:
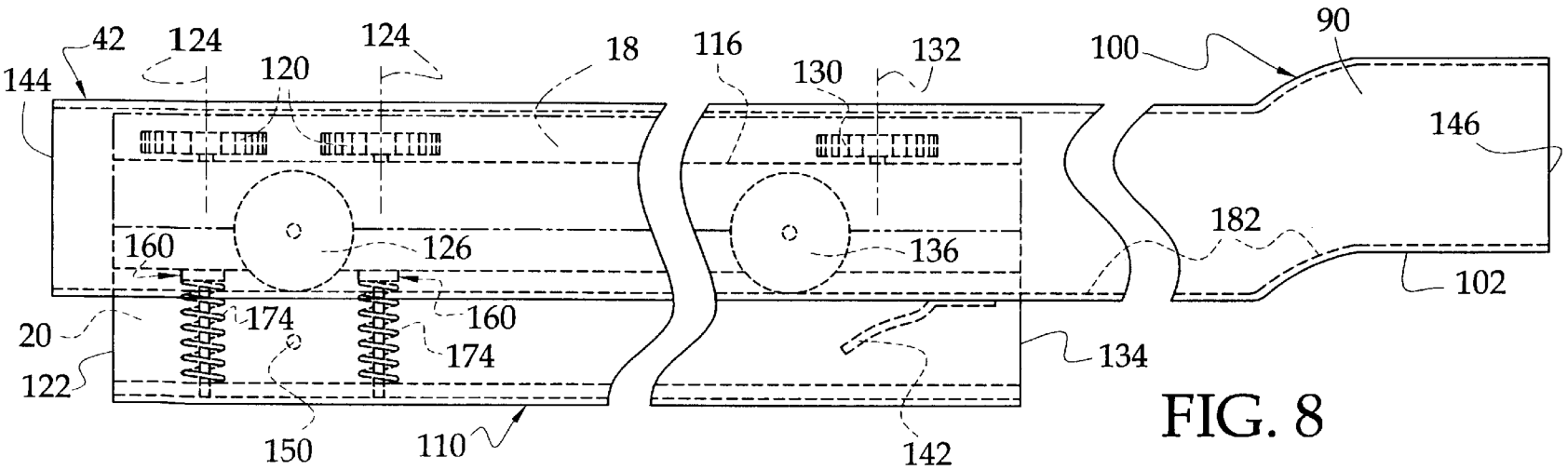
FIG. 8 is a top plan view of the security door with the sliding panel in the retracted position.

Operation of the security door will now be explained, with reference to FIGS. 5 to 8. In FIGS. 6 and 8, the sliding panel 20 is shown in the retracted position with a gap 180 between the sliding panel 20 and the fixed panel 18. As the sliding panel 120 is slid toward the extended position, the upper roller bearings 120, 130 ride along an inner surface 181 of the lower leg 92 and the upper guide bearings 126, 136 ride along an inner surface 182 of the flange 96. Likewise, the lower roller bearing 138 and the lower guide bearing 140 ride along respective inner surfaces (not shown) of the lower guide track 44. As the sliding panel 120 approaches the extended position, the upper guide bearing 136 travels along the S-shaped section 100, causing the leading edge of the panel 20 to move inwardly toward the sliding door assembly 16 and thus seal 176, as represented by arrow 186 in FIG. 7. Simultaneously, the lower guide bearing 140 travels along the S-shaped section 104 and the guide pin 150 travels along the inner surface 154 of the S-shaped bracket 142, causing the trailing edge of the panel 20 to move inwardly toward the seal 176, as represented by arrow 188 in FIG. 7. In this manner, the sliding panel only contacts the seal 176 when in the extended position. This feature permits a better seal between the doors while significantly reducing wear of the seal 176 since the sliding panel is not in constant frictional contact with the seal 176 during movement. If desired, the seal 176 or an additional seal may continue around the casing 14 such that the sliding panel 20 contacts the entire seal in the extended position.

Figure 9:
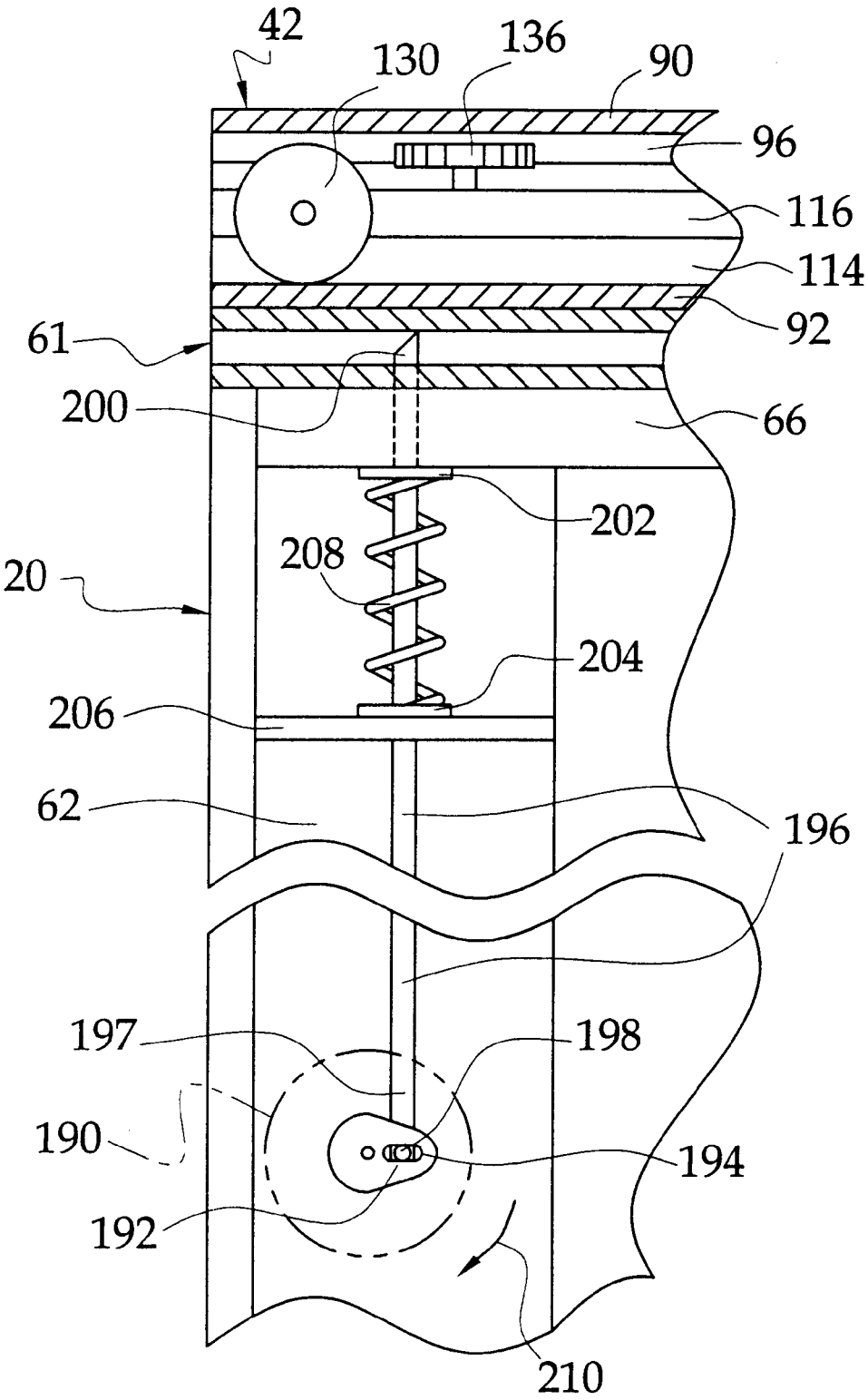
FIG. 9 is a rear plan view of a portion of the sliding panel showing a locking mechanism for securing the sliding panel against movement.

With reference now to FIG. 9, the elongate, tubular member 61 is fixedly secured to the lower leg 92 of the upper guide track 42. A doorknob 190 (shown in phantom line) is mounted for rotation on the leading frame section 62 for locking the sliding door in the extended or retracted positions. A lever arm 192 with a slot 194 is connected to the doorknob for rotation therewith. A rod 196 has a lower end 197 connected to the lever arm and an upper end 200 that normally extends through an opening (not shown) in the tubular member 61. Preferably, a pin 198 is formed at the lower end 197 of the rod and extends through the slot 194. A flange 202 is fixedly secured to the rod 196, while a washer 204 slidably receives the rod. The washer 204 is preferably supported on a shelf 206 that forms part of the leading frame section 62. A compression spring 208 is mounted over the rod 196 and extends between the upper cross frame section 66 and the washer 204. The compression spring normally biases the rod into the tubular member 61 to thereby lock the sliding panel 20 against movement with respect to the upper guide track 42.

In operation, the doorknob 190 is rotated in a direction as represented by arrow 210 to thereby lower the upper end 200 of the rod 196 out of engagement with the tubular member 61. The slot 194 in the lever arm 192 assures that the rod moves in a linear fashion. The knob is then held in the rotated position while sliding the panel 20 to the retracted position. Once in the retracted position, the knob may be released, thereby moving the upper end 200 of the rod 196 into engagement with a second opening (not shown) in the tubular member for holding the panel 20 in the retracted position with respect to the upper guide track 42.

In an alternative arrangement, the tubular member 61 may be eliminated and the rod 196 may instead extend through openings in the lower leg 92 of the upper guide track 42 coincident with the extended and retracted positions.

It is to be understood that the terms upright, upper, lower, inner, outer, leading, and trailing, along with and their respective derivatives as used throughout the specification, including the appended claims, refer to relative, rather than absolute positions and/or orientations.

While the invention has been taught with specific reference to these embodiments, those skilled in the art will recognize that changes can be made in form and detail without departing from the spirit and the scope of the invention. For example, although the panel 18 is preferably fixed, it can be mounted for sliding movement while the panel 20 is fixed. Alternatively, both the panels 18, 20 may be mounted for sliding movement. Moreover, the panels may be constructed from one or more layers of solid material. Although the upper guide track is shown as extending approximately the full length of the casing and the lower guide track as extending approximately half the length, the upper and lower guide tracks may be switched such that the lower guide track extends approximately the length of the casing and the upper guide track extends approximately half the length of the casing. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

The embodiments for which an exclusive property or privilege is claimed are defined as follows:

1. A door assembly for mounting to a casing, the door assembly comprising:

a frame adapted for connection to the casing, the frame including an upper guide track and a lower guide track spaced from the upper guide track;

a first panel having a top edge, a bottom edge, and leading and trailing edges extending between the top and bottom edges, the first panel being connected to the upper and lower guide tracks;

a second panel having a top edge, a bottom edge, and leading and trailing edges extending between the second panel top and bottom edges, the second panel being slidably connected to the upper and lower guide tracks for sliding movement with respect to the first panel between a retracted position wherein the first and second panels are in opposing relationship, and an extended position wherein the trailing edge of the second panel is proximal the leading edge of the first panel, said second panel being free of the bottom track in an area proximal the bottom and leading edges of the second panel;

said lower guide track having a length that is approximately equal to a distance between the trailing edge of the first panel and the leading edge of the second panel with the second panel in the extended position;

the upper guide track having a length that is approximately equal to a distance traveled by the second panel between the retracted and extended positions;

a first bearing assembly mounted proximal the top and leading edges of the second panel;

a second bearing assembly mounted proximal the top and trailing edges of the second panel;

a third bearing assembly mounted proximal the bottom and trailing edges of the second panel;

where the first and second bearing assemblies are operably connected to the upper guide track and the third bearing assembly is operably connected to the lower guide track to thereby permit slidable movement between the second panel and the frame; and wherein the upper guide track has a first end proximal the trailing edge of the second panel in the retracted position and a second end proximal the leading edge of the second panel in the extended position, and further wherein the upper guide track includes an upper curved section proximal the second end thereof for moving at least the leading edge of the second panel generally inwardly toward the casing during movement of the second panel toward the extended position.

2. A door assembly according to claim 1, wherein the lower guide track has a first end proximal the trailing edge of the second panel and a second end proximal the leading edge of the second panel when in the retracted position, and further wherein the lower guide track includes a lower curved section proximal the second end thereof for moving at least a lower portion of the trailing edge of the second panel generally inwardly toward the casing during movement of the second panel toward the extended position.

3. A door assembly according to claim 2, and further comprising:

a guide bracket having a curved surface, the guide bracket being mounted on the upper guide track at a location that is proximal the leading edge of the second panel when in the retracted position; and a guide pin projecting from the second panel, the guide pin being engageable with the curved surface during movement of the second panel toward the extended position for moving at least an upper portion of the trailing edge of the second panel generally inwardly toward the casing.

4. A door assembly according to claim 3, wherein the upper curved section, the lower curved section, and the curved surface have substantially the same curvature.

5. A door assembly for mounting to a casing, the door assembly comprising:

a frame adapted for connection to the casing, the frame including an upper guide track and a lower guide track spaced from the upper guide track;

a first panel having a top edge, a bottom edge, and leading and trailing edges extending between the top and bottom edges, the first panel being connected to the upper and lower guide tracks;

a second panel having a top edge, a bottom edge, and leading and trailing edges extending between the second panel top and bottom edges, the second panel being slidably connected to the upper and lower guide tracks for sliding movement with respect to the first panel between a retracted position wherein the first and second panels are in opposing relationship, and an extended position wherein the trailing edge of the second panel is proximal the leading edge of the first panel;

said lower guide track having a length that is approximately equal to a distance between the trailing edge of the first panel and the leading edge of the second panel with the second panel in the extended position;

the upper guide track having a length that is approximately equal to a distance traveled by the second panel between the retracted and extended positions; and wherein the upper guide track has a first end proximal the trailing edge of the second panel in the retracted position and a second end proximal the leading edge of the second panel in the extended position, and further wherein the upper guide track includes an upper curved section proximal the second end thereof for moving at least the leading edge of the second panel generally inwardly toward the casing during movement of the second panel toward the extended position.

6. A door assembly according to claim 5, wherein the lower guide track has a first end proximal the trailing edge of the second panel and a second end proximal the leading edge of the second panel when in the retracted position, and further wherein the lower guide track includes a lower curved section proximal the second end thereof for moving at least a lower portion of the trailing edge of the second panel generally inwardly toward the casing during movement of the second panel toward the extended position.

7. A door assembly according to claim 6, and further comprising:

a guide bracket having a curved surface, the guide bracket being mounted on the upper guide track at a location that is proximal the leading edge of the second panel when in the retracted position; and a guide pin projecting from the second panel, the guide pin being engageable with the curved surface during movement of the second panel toward the extended position for moving at least an upper portion of the trailing edge of the second panel generally inwardly toward the casing.

8. A door assembly according to claim 7, wherein the upper curved section, the lower curved section, and the curved surface have substantially the same curvature.

9. A door assembly according to claim 7, and further comprising a bearing bracket having a first end connected to at least the second bearing assembly and a second end connected to the second panel for translation therewith.

10. A door assembly according to claim 9, wherein the second panel is spring biased outwardly away from the casing and toward the bearing bracket, such that the guide pin engages the curved surface of the guide bracket under bias force.

11. A security door assembly for mounting to a casing that has at least one movable member for selectively blocking and exposing one environment with another; the security door assembly comprising:

a frame adapted for rotatable connection to the casing about a generally vertical axis the frame including an upper guide track and a lower guide track spaced from the upper guide tracks the upper and lower guide tracks extending in a general horizontal direction;

a first panel having a top edge, a bottom edge, and leading and trailing edges extending between the top and bottom edges, the first panel being connected to the upper and lower guide tracks;

a second panel having a top edge, a bottom edge, and leading and trailing edges extending between the top and bottom edges, the second panel being slidably connected to the upper and lower guide tracks for sliding movement with respect to the first panel between a retracted position wherein the first and second panels are in opposing relationship, and an extended position wherein the trailing edge of the second panel is proximal the leading edge of the first panel;

the upper guide track having a first end proximal the trailing edge of the second panel in the retracted position and a second end proximal the leading edge of the second panel in the extended position; and the lower guide track having a first end proximal the trailing edge of the second panel when in the retracted position and a second end proximal the trailing edge of the second panel when in the extended position, wherein the upper guide track includes an upper curved section proximal the second end thereof for moving at least the leading edge of the second panel generally inwardly toward the casing during movement of the second panel toward the extended position.

12. The security door assembly according to claim 11, wherein the lower guide track includes a lower curved section proximal the second end thereof for moving at least a lower portion of the trailing edge of the second panel generally inwardly toward the casing during movement of the second panel toward the extended position.

13. The security door assembly according to claim 12, and further comprising:

a guide bracket having a curved surface, the guide bracket being mounted on the upper guide track at a location that is proximal the trailing edge of the second panel in the extended position; and a guide pin projecting from the second panel, the guide pin being engageable with the curved surface during movement of the second panel toward the extended position for moving at least an upper portion of the trailing edge of the second panel generally inwardly toward the casing.

14. A door assembly according to claim 11, wherein the second panel is free of the bottom track in an area proximal the bottom and leading edges of the second panel.

* * * * *